United States Patent [19]

Pitsch

[11] Patent Number: 4,685,755

[45] Date of Patent: Aug. 11, 1987

[54] TERMINAL ASSEMBLY

[75] Inventor: Daniel M. Pitsch, Minneapolis, Minn.

[73] Assignee: ADC Telecommunications, Inc., Minneapolis, Minn.

[21] Appl. No.: 830,978

[22] Filed: Feb. 19, 1986

[51] Int. Cl.[4] ..... H01R 4/24

[52] U.S. Cl. ..... 439/404

[58] Field of Search ..... 339/97 R, 97 P, 98, 339/99 R

[56] References Cited

U.S. PATENT DOCUMENTS 4,278,315 7/1981 Osborne ..... 339/113 B 4,624,521 11/1986 Vachhani ..... 339/97 P

*Primary Examiner*—Joseph H. McGlynn

*Attorney, Agent, or Firm*—Merchant, Gould, Smith, Edell, Welter & Schmidt

[57] ABSTRACT

A terminal assembly is disclosed consisting of a base member and a terminal member which is secured to the base member in one of two releasable positions. The terminal member is one of two releasable positions. The terminal member includes an elongated panel formed of insulative material and has a plurality of chambers which receive a plurality of split cylinder connectors aligned in parallel side by side relation. When in the first position, a first end of the connectors are exposed for receiving a plurality of wires. When in the second position the second end of the connectors are exposed for receiving electrical wires. Guideways are disposed on ends of the assembly for guiding a first plurality of wires to the second ends of the connectors. A second set of guideways are provided on the base member and the panel member intermediate the side ends for guiding a second plurality of wires from an intermediate location through the guideways and to the first ends of the electrical connectors. Latch mechanisms are provided for releasably securing the terminal member to the base member in either of the first or second positions and a window formed in the base member provides for flexing of wires as the terminal member is rotated between either of the first and second positions.

13 Claims, 9 Drawing Figures

VI
VII

TERMINAL ASSEMBLY

BACKGROUND OF THE INVENTION

I. Field of the Invention

This invention pertains to assemblies for electrically connecting a plurality of wire conductors. More particularly, this invention pertains to a terminal assembly for electrically connecting a plurality of wire conductors from a facility cable to a plurality of cross connect wires with the apparatus being adaptable to permit changing of cross connect wires while retaining organization of the plurality of wire conductors.

II. Background of the Invention

In the telecommunications industry, the number of instances in which wire to wire electrical connections must be made is immense. In order to make the number of connections and management of such connections feasible, the art has developed apparatus to provide ready connection of wires and maintain and organize the wires. An example of such an apparatus is shown in U.S. Pat. No. 4,278,315 to Osborne dated July 14, 1981. The Osborne patent teaches a modular system for interconnecting insulated wires contained in a plurality of cables. The system includes a module having a channel-like base member and two separate support members on each side of the channel for releasably supporting a plurality of connector blocks between the support members. Another apparatus for effecting electrical connections in the telecommunications industry is shown in commonly assigned co-pending U.S. patent application Ser. No. 658,268 of Carl Pohl entitled "Electrical connector Module with Multiple Connector Housings" now abandoned. The Pohl patent application shows an electrical connection assembly having a plurality of split cylinder connectors disposed to receive a plurality of insulated wires in side-by-side relation which are inserted into the connectors. Slots in the connectors engage the insulation and pierce it to provide electrical and mechanical contact with the wire conductor. A blade disposed on the cylindrical connector diametrically opposed to the slot severs excess wire as the electrical connection is made.

Notwithstanding advances made in the art to provide electrical connections, continuing need is recognized to improve the design of electrical connection assemblies to provide for apparatus which is mechanically sound and permits ease of installation and organization of wires to be connected. Also, it would be desirable for such an apparatus to provide ready access to the connectors to rearrange and rewire connections from time to time. Finally, it would be also desirable to provide such an apparatus with means for protecting wires from undue bending and breakage during use of the apparatus.

OBJECTS AND SUMMARY OF THE INVENTION

It is an object of the present invention to provide a terminal assembly for interconnecting a plurality of insulated wires.

A further object of the present invention is to provide a terminal assembly of enhanced mechanical strength and which provides organization of wires to be connected by the assembly.

A yet further object of the present invention is to provide a terminal assembly which includes means for permitting rewiring of the electrical connections from time to time and provides means for protecting conductor wires from breakage during handling of the assembly.

According to a preferred embodiment of the present invention there is provided a terminal assembly comprising a base member and a terminal member. The terminal member has an elongated panel formed of electrically insulative material. Defined within the panel are a plurality of parallel aligned electrical connector receiving chambers which extend through the panel from a first longitudinal end to a second longitudinal end of the panel. A plurality of slits are formed through the panel at the first and second longitudinal ends with the slits disposed transverse to the longitudinal ends. A plurality of electrical connectors formed of electrically conductive material are sized to be securely received within the chambers. A connector received within a chamber presents a wire receiving slot aligned with a slit formed through the panel. A wire terminating blade is provided on the connector on a side thereof diametrically opposed to the wire receiving slot. The electrical connector presents wire receiving ends having slots and blades disposed on both the first longitudinal end of the panel and on the second longitudinal end of the panel. A first latch mechanism is provided for releasably securing the terminal member to the base member in a first position with first ends of the electrical connectors exposed and with second ends of the electrical connector opposing the base member. A second latch mechanism is provided for releasably securing the terminal member to the base member in a second position with the second ends of the electrical connectors exposed and with the first ends of the electrical connectors opposing the base member. A first guide mechanism is provided for guiding a first plurality of wire conductors from side ends of the base member and the terminal member to connector ends disposed on one of the longitudinal ends of the panel. A second guide mechanism is provided for guiding a second plurality of wire conductors from a location intermediate side ends of the panel to connectors on an opposite longitudinal end of the panel. Opposing surfaces of the terminal member and base member define a window sized to accomodate flexing of the second plurality of conductors as the terminal is moved between the first and second positions.

DESCRIPTION OF THE PREFERRED EMBODIMENT

Figure 1:
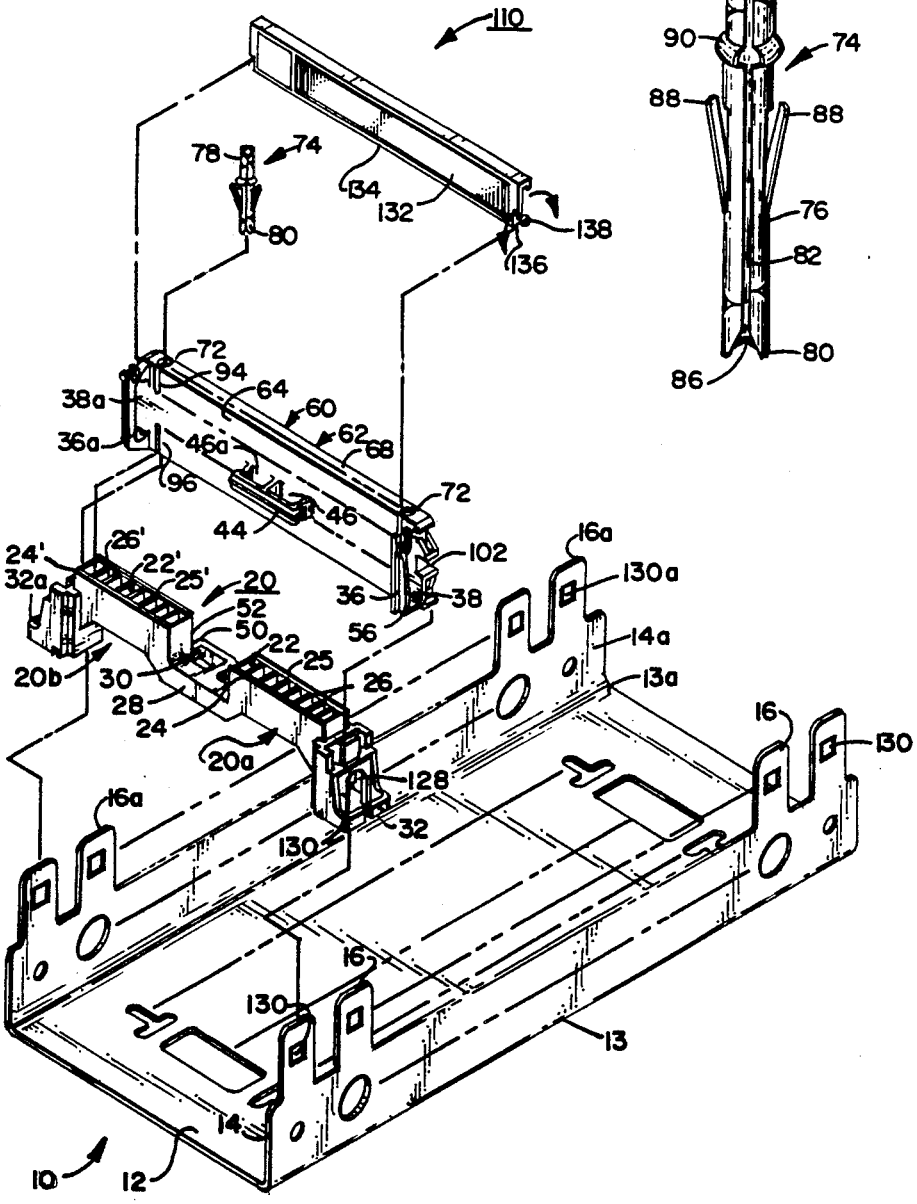
FIG. 1 is a perspective view in exploded format showing the terminal assembly of the present invention.

Referring to the drawings and with initial reference to FIG. 1, a terminal assembly is shown for providing electrical connection between a plurality of insulated conductor wires. In the preferred embodiment, the terminal assembly is for use in the telecommunications industry. The assembly includes a retaining element 10 which is preferably formed of sheet metal and which is U shaped in cross section. Retaining element 10 has a flat base wall 12 which is rectangular in shape and a pair of identical upwardly extending side walls 14 and 14*a* projecting generally perpendicular to base wall 12 along its longitudinal edges 13 and 13*a*. A plurality of projecting tabs 16 and 16*a* extend projecting from side walls 14, 14*a*, respectively, with tabs 16 parallel to and opposing tabs 16*a*. In application, retaining element 10 is secured in an upright position with base wall 12 being vertical. Releasably connected to each opposing pair of tabs 16 and 16*a* is a base member 20 which carries a terminal member 60 and a lid member 110, all of which will be described separately.

A. TERMINAL MEMBER

Terminal member 60 includes a generally rectangular narrow panel 62 having a pair of spaced apart flat parallel side wall faces including a first side wall face 64 and a second side wall face 66. A first longitudinal edge 70 joins side walls 64 and 66 on first edges thereof and a second longitudinal edge 68 joins side walls 64 and 66 at second edges thereof.

Figure 2:
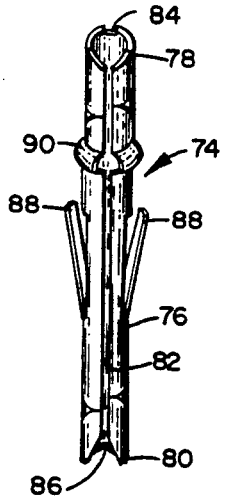
FIG. 2 is a view of a split cylinder connector for use in the terminal assembly.
Figure 9:
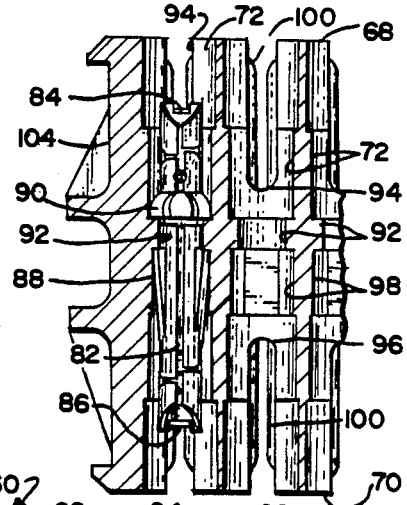
FIG. 9 is a view taken in section of a portion of the terminal member including a split cylinder connector.

Shown best in FIG. 9, the panel 62 which is formed of an electrically insulative material, defines a plurality of parallel aligned electrical connector receiving chambers 72 which extend through the panel completely from first edge 70 to second longitudinal edge 68. Each of chambers 72 is identical and are generally cylindrical having their cylindrical axes parallel aligned and parallel to side walls 64 and 68 and perpendicular to longitudinal edges 68 and 70. Each of the chambers 72 is sized to receive a split cylinder electrical connector 74 shown best in FIG. 2. Connector 74 is a conventional split cylinder connector and has a generally cylindrical body 76 extending from a first wire receiving end 80 to a second wire receiving end 78.

The split cylinder connector 74 is provided with a wire receiving slot 82 which extends axially from first end 80 to second end 78. The wire receiving slot 82 is sized to receive an insulated wire with slot defining edges of the split cylinder connector piercing the wire insulation to provide sound electrical and mechanical connection between the wire conductor and the slot defining edges of the connector 74. First end 80 and second end 78 are provided with a first wire termination blade 86 and a second wire termination blade 84, respectively. Blades 84 and 86 are disposed on ends 78 and 80 diametrically opposed to the positioning of axial slot 82.

The connector 74 includes a pair of diametrically opposed prongs 88 on one side of the connector adjacent end 80 and a protruding crown 90 spaced from prongs 88 on a side adjacent end 78. As shown in FIG. 9, the connector receiving chambers 72 are provided with a reduced diameter portion 92 sized to receive a cylinder having a diameter of the connector body 76 but smaller than the diameter of crown portion 90 or the spaced apart position of prongs 88. Connector 74 is secured within panel 62 by inserting connector 74 into the chamber 72 by first passing first wire receiving end 80 through second edge 68 and urging the connector in a direction with wire receiving end 80 being urged toward first longitudinal edge 70. As prongs 88 pass the reduced diameter portion 92, the prongs 88 are urged inwardly to conform with the diameter of body 76. After the prongs 88 pass the reduced diameter portion 92 the prongs 88 snap outwardly. The reduced diameter portion 92 is now trapped between prongs 88 and crown 90 thereby securely fixing connector 74 within chamber 72.

The panel 62 is provided with a first plurality of transverse slits 96 formed through the panel at the first longitudinal edge 70. Slits 96 are disposed to be in axial alignment with each of chambers 72. Similarly, a second plurality of transverse slits 94 are formed through panel 62 at the second longitudinal edge 68 and in axial alignment with each of the connector receiving chambers 72.

Figures 3, 4, 5, 8:
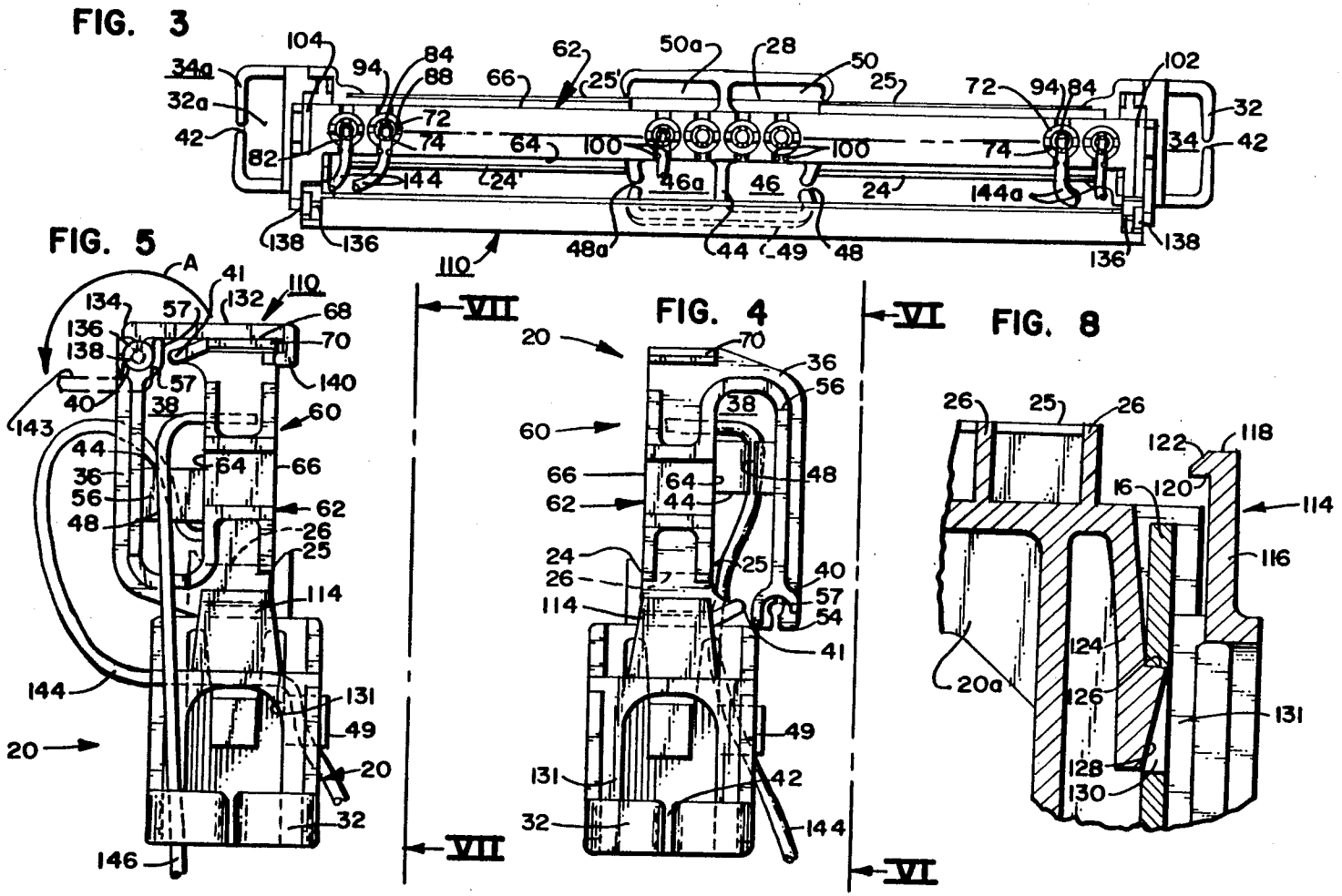
FIG. 3 is a top plan view of the terminal assembly.
FIG. 4 is a side elevation view of the terminal assembly showing a terminal member secured to a base member in a first of two positions.
FIG. 5 is a side elevation view of the terminal assembly showing a terminal member secured to a base member in a second of two positions.
FIG. 8 is an enlarged cross sectional view of the latching mechanism of the terminal assembly.

Shown best in FIGS. 3 and 9, the split cylinder connectors 74 are aligned within chambers 72 with prongs 88 disposed within axial notches 98 and with the prongs lying in a plane generally parallel to the side faces 64 and 66. The connectors 74 are disposed within the chamber 72 with the wire receiving slot 82 at the first wire receiving end 80 and second wire receiving end 78 aligned with the first plurality of transverse slits 96 and the second plurality of transverse slits 94, respectively, on a side of the slits adjacent the first side wall face 64. The first and second wire termination blades 86 and 84 are aligned with the first and second plurality of transverse slits 96, 94 on sides of the slits adjacent the second side wall face 66. A strain relief in the form of parallel inwardly protruding ribs 100 are provided within the first and second plurality of slits 96 and 94 on the sides thereof adjacent first side wall face 64 and disposed between face 64 and the wire receiving slot 82 of connector 74. Ribs 100 project inwardly into slits 94 and 96 with the spacing between opposing ribs 100 being slightly less than the outside diameter of an insulated wire to be inserted within the slot 82.

B. BASE MEMBER

Figure 6:
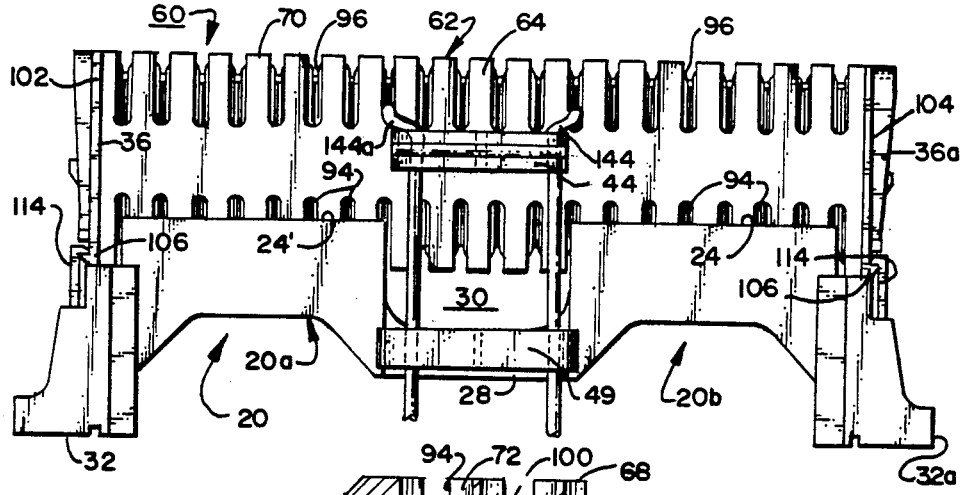
FIG. 6 is a frontal view taken in elevation of the terminal assembly showing a terminal member secured to the base member in the a first position and taken along line VI—VI of FIG. 4.

Base member 20 includes means (as will be described) for releasably connecting the base member 20 to opposing tabs 16 and 16*a* with the base member 20 sized to span tabs 16 and 16*a* and rigidly connect the tabs. The base member 20 has a longitudinal edge 22 disposed to face away from base wall 12 when base member 20 is secured spanning tabs 16 and 16*a*. The edge 22 has a pair of spaced apart longitudinal ridges 24 and 25 which are in parallel alignment. A plurality of transverse ridges 26 extend between longitudinal ridges 24 and 25. Ridges 24 and 25 are spaced apart a distance sized to receive first and second side wall faces 64, 66 of panel 62 in between ridges 24 and 25. Transverse ridges 26 are disposed and sized to be received within opposing transverse slots 96 when terminal member 60 is secured to base member 20 in a first position (as shown in FIGS. 4 and 6). Likewise, transverse ridges 26 are aligned and disposed to be received within the second plurality of transverse slits 94 when the terminal member 60 is secured to base member 20 in a second position (shown in FIGS. 5 and 7).

Figure 7:
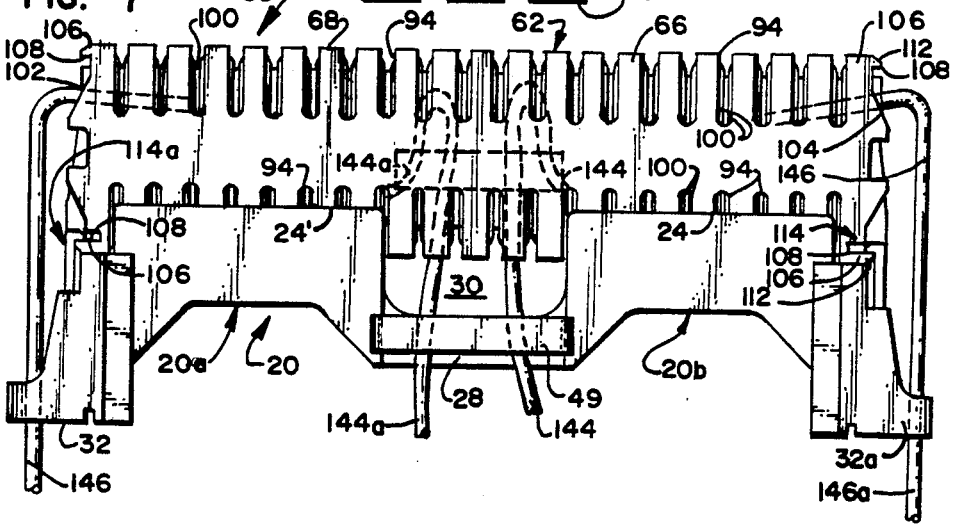
FIG. 7 is a frontal view taken in elevation of the terminal assembly showing the terminal member secured to the base memeber in the second position and taken along line VII—VII of FIG. 5.

As shown best in FIGS. 1, 6 and 7, base member 20 is provided with a central bridge 28 separating the base member into a first portion 20*a* and a second portion 20*b* effectively separating edge 22 to present separate second half 22′ having ridges 24′, 25′ and 26′. Bridge member 28 rigidly connects first half 20*a* and second 20*b* of base member 20. Bridge member 28 is spaced away from edges 22 and 22′ with bridge member 28 and opposing surfaces of halves 20*a* and 20*b* defining a window 30 to accomodate flexing movement of wires as will be described.

C. FASTENING MECHANISMS

Latch mechanisms are provided for releasably securing the terminal member 60 to the base member 20 in either the first or second position as previously described. Side ends 102 and 104 are each provided with two opposing hook members 106 (shown in FIG. 7). The hook members 106 are positioned at the corners of the longitudinal edges 68, 70 and side ends 102, 104. Each of the hook members 106 presents a hook surface 108 which is generally parallel to the longitudinal edges 68 and 70 and perpendicular to side ends 102 and 104. A ramp surface 112 projects at an angle from a corner at the intersection between the longitudinal edges and the side ends and projects to the free end of surface 108.

Each of base member portions 20*a* and 20*b* is provided with a mating latching mechanism 114 and 114*a*, respectively, which are identical and the description of mechanism 114 will suffice as a description of mechanism 114*a*. With reference to FIG. 8, latch mechanism 114 is shown including a first flexible hook 116 projecting parallel to the side end 102 when terminal member 60 is placed on base member 20 and with ridges 26 received within either of slits 94 or 96. Flexible hook 116 includes a hook end 118 having a capture surface 120 which is generally parallel to hook surface 108 and disposed to oppose hook surface 108. A cam surface 122 projects away from capture surface 120 and is disposed to oppose a ramp surface 112 of a hook member 106 as terminal member 60 is being inserted onto base member 20 in either of the first or second positions. Flexible hook member 116 is flexible in that it may be engaged at its hook end 118 and urged away from opposing hook member 106 to free the terminal member so that it may be selectively positioned in either of the first or second positions.

Also shown in FIG. 8, the base member 20 includes a flexible clip 124 having a clip surface 126 which extends generally parallel to and spaced from hook surface 118 and separated in their parallel direction by a predetermined spacing. Flexible clip 124 also includes a cam surface 128. A rigid wall 131 opposes a plane of the flexible clip 124. With flexible clip 124 provided as described, the base member 20 may be slipped onto a protruding tab 16 with flexible clip 124 flexing to a point with surface 126 being received within a clip receiving opening 130 formed through tab 16. When so received, clip surface 126 opposes opening defining surfaces of tab 16 in opposing relation and rigid wall 131 opposes the surfaces of the tab 16 to thereby rigidly capture the base portion 20*a* on tab 16. It will be appreciated that base portion 20*b* has identical clips for securing the portion to tab 16*a*. Consequently, the rigid base 20 spans tabs 16 and 16*a* and provides enhanced structural integrity to side walls 14 and 14*a* of retaining element 10.

D. CONDUCTOR GUIDEWAYS

A first guide mechanism is provided for guiding a first plurality of wire conductors from side ends of the base member and terminal member. The first guide mechanism includes a pair of guideway defining clips 32 and 32*a* secured to side ends of base portions 20*a* and 20*b*, respectively. The guideway defining clips 32 and 32*a* define an open wire guideway 34 and 34*a* (shown in FIG. 3) disposed in a plane generally parallel to the surface of longitudinal edges 68 and 70 and disposed along the side ends 102 and 104. A second pair of guideway defining clips 36, 36*a* are disposed on first side wall face 64 of panel 62 adjacent side ends 102, 104, respectively. The opposing surfaces of clips 36 and 36*a* and side wall 64 define a second open wire guideways 38 and 38*a* (shown in FIGS. 1, 4 and 5) which are generally in a plane parallel to the plane of the side ends 102 and perpendicular to surface 64 and edges 68, 70. As shown best in FIG. 4, clip 36 terminates at a free end 40 which is spaced away from panel member 62 by a gap 41 of predetermined size which is preferably just slightly less in dimension than the diameter of insulated wires to be connected to the assembly. Clip 36 is flexible to permit wires to pass through gap 41. Likewise, clips 32 and 32*a* are provided with gaps 42, 42*a* of similar dimension for passing a wire through the clips into guideways 34 and 34*a*.

Intermediate guideways are provided for guiding a second plurality of wire conductors from a location intersecond mediate the side ends 102, 104. The intermediate guide ways include a first intermediate guideway clip 44 secured to face 64 between longitudinal edges 68 and 70. Clip 44 is T-shaped in configuration such that opposing surfaces of clip 44 and surface 64 define a pair of longitudinally spaced apart intermediate guideway openings 46 and 46*a*. Similar to the construction of gaps 40 and 42, each of guideway openings 46 is provided with a gap 48 and 48*a* respectively. Guideway openings 46 and 46*a* are disposed opening in a plane generally perpendicular to surface 64 and extending therefrom in a direction generally parallel to the surface of edge 68. Clip 44 is disposed such that when terminal member 60 is positioned on base member 20 in either of the first or second positions, clip 44 will be centrally located above the bridge member 28 of base member 20. A second intermediate guideway clip 49 is secured to the base member 28 and, like clip member 44 is T-shaped to define a pair of adjacent guideway openings 50 and 50*a* having gaps 52 and 52*a* with openings 50 and 50*a* disposed parallel to and aligned with openings 46 and 46*a* when terminal member 60 is secured to base member 20 in the first position (as shown in FIGS. 4 and 6).

E. LID MEMBER

The assembly 18 is provided with a lid member 110 which is removably and pivotally secured to terminal member 60. The lid member 110 includes a lid cap 132 which is generally rectangular and sized to have a longitudinal dimension generally equal to the longitudinal dimension of edge 68. Cap 132 is further sized to have a transverse dimension equal to the distance between free end 40 of clip 36 and second side wall face 66. A first longitudinal edge 134 of lid cap 132 is provided with a pair of pivot pins 136 at opposite ends thereof. Pivot pins 136 are axially aligned and terminate at enlarged retainer disks 138. Referring to FIG. 4, clip 36 at its free end 40 is provided with a slot 54 having a central enlarged portion sized to pivotally receive pin 136. A reinforcing rib 56 extends along the length of clip 36 and at free end 40 defines a cup 57 sized to receive retaining disk 138. Accordingly, lid member 110 may be secured to terminal member 60 by releasably urging pivot pins 136 into the enlarged portions of slots 54 with the lid pivotable about pins 136. On an edge of lid cap 132 opposite first edge 134 a protruding lip 140 is provided to engage surface 66 in friction snug engagement when the lid 110 is pivoted to a down position as shown in FIG. 4. The lid may be pivoted about the pins 136 approximately 180 degrees in the direction of the arrow A in FIG. 5 to an open position (as shown by phantom lines) with the lid presenting an under surface 143 which may be marked with any suitable markings to assist the user of the apparatus of the invention.

F. METHOD OF OPERATION

Having described the structure of the present invention in a preferred embodiment, the method of operation of the apparatus will now be described. As mentioned, the preferred use of the present invention is for making terminal connections in the telecommunications industries. In such environments, connections are commonly made between relatively unchanging conductors (which may be conveniently referred to as permanent or facility conductors) and cross connect wires which may be changed from time to time. To initially install the terminal assembly of the present invention and initially wire facility conductors and cross connect conductors, the base member 20 is secured to the retaining element 12 by urging the body portions 20*a* and 20*b*-over tabs 16 and 16*a*. flexible clips 124 snap into openings 130, 130*a*. So positioned, the base member 20 is securely fastened to retaining element 10 and the solid structure of base member 20 spanning clips 16 and 16*a* rigidly supports a terminal member 60.

The terminal member 60 is attached to base member 20 with terminal member 60 in the first position with edge 68 opposing edge 22 and with transverse ridges 26 received within transverse slits 96. Terminal member 60 is urged toward base member 20 with cam surface 122 of first flexible hook 116 acting against an opposing ramp surface 112 of hook member 106 thereby forcing flexible hook 116 away from hook member 106 until terminal member 60 is fully positioned within base member 20 at which point flexible hook 116 will snap into place with capture surface 120 opposing hook surface 108.

Facility wires from a facility cable (not shown) are passed through guideway openings 50 and 50*a* and through aligned guideway openings 46 and 46*a*. Conductors (shown partially in FIGS. 4 and 6 at 144) which are passed through aligned guideways 50 and 46 are layed in side-by-side relation within slits 96 on the right-hand side of the panel 62 (with reference to FIG. 6) and held in place by being snuggly received between opposing ribs 100. Likewise, conductors such as conductor 144*a* which are guided by guideways 46*a* and 50*a* are layed in side by side relation within slits 96 on the left-hand side of the panel member and retained in place by opposing ribs 100. When all facility wires are so installed in side by side relation, the wires may be urged into electrical and mechanical contact with the split cylinder connector 74 by forcing them into the connector slot 82 with any suitable tool such as that shown in co-pending and commonly assigned U.S. patent application Ser. No 830,979, 2/9/86 filed on even date herewith and naming George B. Pfeffer as inventor and entitled "Insertion Tool" or a tool such as shown in commonly assigned copending U.S. patent application Ser. No. 800,998. The tool forces the wire into the wire receiving slot which pierces the insulation and makes a sound mechanical and electrical contact with the wire conductor. The tool also urges the free end of the wire against the blade 86 thereby terminating excess wire. FIG. 6 shows the assembly with facility wires 144 and 144*a* installed and prior to insertion of cross connect wires 146 and 146*a*.

With the facility wires installed, flexible hooks 116 are urged out of hooking engagement with hooks 106. Terminal member 60 is lifted off of the base member 20. The terminal member is now rotated 180 degrees about its longitudinal axis in a clockwise direction when viewed in FIG. 4. After being so rotated, the relative positioning of the terminal member 60 and base member 20 will be such as is shown in FIGS. 5 and 7. In rotating the terminal member 60 from the first position shown in FIG. 4 to the second position shown in FIG. 5, the facility conductors, such as wires 144 and 144*a*, are pulled through window 30 which accommodates the flexing of the 20 wires such that the wire may now be looped through window 30 with the flexed shape of wire 144 shown in FIG. 5. With the terminal member 60 now in the position as shown in FIGS. 5 and 7, cross connect wires such as wires 146 and 146*a* are fed through guideways 34 and 34*a* and guideways 38 and 38*a*, respectively. The wires fed through guideway 38 are disposed in side by side relation on the left-hand side of panel 62 (with reference to FIG. 7) by inserting the wires in side by side relation into each of slits 94 with ribs 100 retaining the wires within the slits. Wires fed through guideways 34*a* and 38*a* are laid similarly in side by side relation within the slits 94 on the right-hand side of the panel 62. With the wires laid in place, the wires are inserted into the connectors as described above through the use of any suitable tool.

With all of the cross connect wires described as above, the lid member 110 is fastened to the assembly 18 by inserting pins 136 within the free end 40 of clips 36. The lid is rotated to the closed position with lid cap 132 covering edge 68 and preventing debris from entering into the electrical connections. The lid also covers gaps 40 to help retain wires within guideway 38. To change cross connect wires, lid 110 is rotated to its open position and necessary wiring changes are made.

If from time to time, it is desirable to change the facility wires, the lid may simply be removed by popping it out of free end 40 and rotating the terminal member 60 about its longitudinal axis 180 degrees in a counter clockwise direction. As before, the window 30 provides necessary room for flexing of the wires 144 and 144*a* while the bridge member 28 retains a rigid connection between bridge halves 20*a* and 20*b*. Any necessary wire change can be made and the terminal returned to its first position and the lid reinstalled.

From the foregoing detailed description of the present invention, it has been shown how the objects of the invention have been obtained in a preferred manner. However, modifications and equivalents of the disclosed concepts such as readily occur to those skilled in the art are intended to be included within the scope of this invention. Thus, the scope of this invention is intended to be limited only the by the scope of the claims as are or may hereafter be appended hereto.

What is claimed is:

1. A terminal assembly comprising:

a base member;

a terminal member having an elongated panel formed of electrically insulative material and defining a plurality of parallel aligned connector receiving chambers extending through said panel from a first longitudinal edge to a second longitudinal edge thereof, a first plurality of slits formed through said panel at said first edge and a second plurality of slits formed through said panel at said second edge, said slits disposed transverse to said edges with said slits extending through opposite side faces of said panel and in communication with said chambers, a plurality of electrical connectors formed of electrically conductive material and sized to be securely received within said chambers with a connector received within a chamber presenting a first end adjacent said first longitudinal edge and having a first wire receiving slot aligned with a side of one of said first plurality of slits extending through a first side face of said panel and said connector first end having a first wire terminating blade aligned with a side of said slit extending through a second side face of said panel, said connector presenting a second end adjacent said panel second longitudinal edge and having a second wire receiving slot aligned with a side of one of said second plurality of said slits extending through said first side face and a second wire terminating blade aligned with a side of said second slit extending through said second side face;

first latch means for releasably securing said terminal member to said base member in a first position with said first edge exposed and with said second edge opposing said base member;

second latch means for releasably securing said terminal member to said base member in a second position with said second edge exposed and with said first edge opposing said base member;

first guide means for guiding a first plurality of wire conductors from side ends of said base member and said terminal member to connector ends on one of said longitudinal edges;

second guide means for guiding a second plurality of wire conductors from a location intermediate said side ends to connectors on another of said longitudinal edges; and window means defined between said base member and terminal member and sized to accommodate flexing of said second plurality of conductors as said terminal member is moved between said first and second positions.

2. A terminal assembly according to claim 1 wherein said first guide means comprises a guideway defining clip disposed on said base member and a guideway defining clip disposed on said panel with said guideway defining clip on said base member defining an open wire guideway opening generally transverse to said panel and said clips on said panel defining an open wire guideway opening generally parallel to said side ends and perpendicular to said first panel face.

3. A terminal assembly according to claim 2 wherein said intermediate guide means comprises an intermediate guideway defining clip disposed on said first surface and aligned with an intermediate guideway clip disposed on said base member with said base member clip and said panel clip defining aligned open guideways when said terminal member is in said first position.

4. A terminal assembly according to claim 3 comprising means for dividing said open guideways of said intermediate panel clip and said intermediate base clip into two portions with portions of said panel guideway aligned with portions of said base guideway.

5. A terminal assembly according to claim 1 wherein said base member has a longitudinal edge having spaced apart longitudinal ridges and a plurality of transverse ridges with said longitudinal ridges sized for said side faces of said panels to be received between said longitudinal ridges when in either of said first or second positions and with said transverse ridges sized and disposed to be received within said first plurality of slits when in said second position and within said second plurality of said slits when in said first position.

6. A terminal assembly according to claim 1 comprising a plurality of strain relief formations formed within said panel in each of said first and second plurality of slits on sides thereof adjacent said first side face and sized to releasably hold a wire conductor within said slits opposing said connectors.

7. A terminal assembly according to claim 5 wherein said base member includes a first portion and a second portion rigidly joined by a bridge member with said bridge member spaced from said longitudinal edge and with opposing surfaces of said second portion, said first portion and said bridge portion defining said window.

8. A terminal assembly according to claim 7 comprising a retaining element in the form of a U-shaped channel having a plurality of upstanding opposing tabs and means for securing said base member to opposing tabs with said base member spanning said channel.

9. A terminal assembly according to claim 1 comprising a lid member sized to cover said first longitudinal edge and means for pivotally and releasably connecting said lid to said panel for said lid member to pivot between a closed position with said lid member opposing said first longitudinal edge and a second position with said lid exposing said first longitudinal edge.

10. A terminal assembly comprising:

a retaining element having a base and a pair of parallel aligned spaced apart first and second side walls, said side walls each presenting a plurality of mounting tabs with tabs on said first side wall opposing tabs on said second side wall;

a base member having a pair of spaced apart first and second clip means for releasably securing said base member to said retaining element with said first clip means secured to a tab on said first side wall and a second clip means secured to an opposing tab on said second side wall, said base member having a body presenting a longitudinal edge facing away from said retaining element;

a terminal member having an elongated panel of electrically insulative material and defining a plurality of parallel aligned connector receiving chambers extending from a first longitudinal edge of said panel to a second longitudinal edge of said panel, a plurality of electrical connectors disposed within each of said chambers with each of said connectors having a first end adjacent said first edge and a second end adjacent said second edge with each of said first and second ends having means for receiving and retaining a wire conductor in electrical and mechanical connection;

first latch means for releasably securing said terminal member to said base member in a first position with said first longitudinal edge exposed and with said second longitudinal edge opposing said base member;

second latch means for releasably securing said terminal member to said base member in a second position with said second longitudinal edge exposed and with said first longitudinal edge opposing said base member longitudinal edge;

first guide means for guiding a first plurality of wire conductors from side ends of said base member and said terminal member to connector ends on one of said longitudinal edges;

second guide means for guilding a second plurality of wire conductors from a location intermediate said side ends to connectors on another of said longitudinal edges; and window means defined between said base member and terminal member and sized to accommodate flexing of said second plurality of conductors as said terminal member is moved between said first and second positions.

11. A terminal assembly according to claim 10 wherein said base member includes a first body portion having a longitudinal edge facing away from said retaining element and a second body portion having a longitudinal edge in linear alignment with said longitudinal edge of said first body portion;

a bridge rigidly connecting said first and second body portions with said bridge spaced away from said longitudinal edges of said first and second body portions on a side thereof opposing said retaining element with said bridge ends opposing surfaces of said body portions defining said window.

12. A terminal assembly according to claim 11 where each of said first and second body portions are provided with linearly aligned longitudinal spaced apart ridges on said longitudinal edges and sized to receive said elongated panel between said base portion longitudinal ridges.

13. A terminal assembly according to claim 10 wherein said first and second body portions are provided with flexible hook members on side ends of said portions and said elongated panel is provided with a pair of rigid hooks on side ends of said panels with a first said of rigid hooks disposed adjacent said first longitudinal edge of said panel and a second set of rigid hooks disposed adjacent said second longitudinal edge of said panel; said first set cooperating with said flexible hook to define said second latch means and said first set cooperating with said flexible hook to define said first latch means.

* * * * *

UNITED STATES PATENT AND TRADEMARK OFFICE

CERTIFICATE OF CORRECTION

PATENT NO. : 4,685,755

DATED : August 11, 1987

INVENTOR(S) : Daniel M. Pitsch

It is certified that error appears in the above-identified patent and that said Letters Patent is hereby corrected as shown below:

Column 1, line 32, "Carl Pohl" should be --Karl Pohl--;

Column 1, line 32, "connector" should be --Connector--;

Column 2, line 45, "accomodate" should be --accommodate--;

Column 2, line 67, "memeber" should be --member--;

Column 5, line 6, "accomodate" should be --accommodate--;

Column 6, line 23, "intersecond mediate" should be --intermediate--;

Column 7, line 24, "16a. flexible" should be --16a. Flexible--;

Column 8, line 57, "only the by the" should be --only by the--; and

Column 11, line 3, "guilding" should be --guiding--.

Signed and Sealed this

First Day of December, 1987

*Attest:*

DONALD J. QUIGG

*Attesting Officer*

*Commissioner of Patents and Trademarks*